US010975787B2

(12) United States Patent
Ikebe et al.

(10) Patent No.: US 10,975,787 B2
(45) Date of Patent: Apr. 13, 2021

(54) INTERNAL COMBUSTION ENGINE

(71) Applicant: HONDA MOTOR CO., LTD., Tokyo (JP)

(72) Inventors: Yoshiyuki Ikebe, Wako (JP); Makoto Harada, Wako (JP); Fumihiko Matsubara, Wako (JP); Toshiaki Deguchi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/494,065

(22) PCT Filed: Feb. 20, 2018

(86) PCT No.: PCT/JP2018/005954
§ 371 (c)(1),
(2) Date: Sep. 13, 2019

(87) PCT Pub. No.: WO2018/180014
PCT Pub. Date: Oct. 4, 2018

(65) Prior Publication Data

US 2020/0132005 A1 Apr. 30, 2020

(30) Foreign Application Priority Data

Mar. 30, 2017 (JP) ..... JP2017-068894

(51) Int. Cl.
*F02D 41/00* (2006.01)
*F01L 1/02* (2006.01)
(Continued)

(52) U.S. Cl.
CPC ..... *F02D 41/009* (2013.01); *F01L 1/022* (2013.01); *F02B 75/22* (2013.01); *F02F 7/0012* (2013.01); *F02B 2075/1808* (2013.01)

(58) Field of Classification Search
CPC ..... F02D 41/009; F01L 1/022; F02B 75/022; F02F 7/0012
See application file for complete search history.

(56) References Cited

U.S. PATENT DOCUMENTS

2001/0039908 A1* 11/2001 Bilek ..... F02B 33/44 114/55.5
2009/0205591 A1* 8/2009 Shand ..... F02B 61/02 123/54.4

FOREIGN PATENT DOCUMENTS

JP 61-72878 A 4/1986
JP 6-2580 A 1/1994
(Continued)

OTHER PUBLICATIONS

International Search Report, issued in PCT/JP2018/005954, dated May 15, 2018.
(Continued)

*Primary Examiner* — Kein A Lathers
(74) *Attorney, Agent, or Firm* — Birch, Stewart, Kolasch & Birch, LLP

(57) ABSTRACT

An internal combustion engine includes a crankcase that rotatably supports a crankshaft, a case cover that liquid-tightly covers a side of the crankcase, a cylinder block that is joined to the crankcase and divides a plurality of cylinders in a V-type arrangement in which the cylinders are disposed above a virtual horizontal plane including a rotational axis of the crankshaft and intersect each other at a bank angle, a to-be-detected body that rotates integrally with the crankshaft, and a detection sensor that is mounted from the outside on the crankcase at a position higher than the virtual horizontal plane and is made to face a trajectory of the to-be-detected body to generate a pulse signal in response to movement of the to-be-detected body. This provides, in a so-called V-type internal combustion engine, a structure for
(Continued)

disposing a detection sensor that can detect the angular velocity of a crankshaft with high precision.

5 Claims, 4 Drawing Sheets

(51) Int. Cl.

| | |
|---|---|
| ***F02B 75/22*** | (2006.01) |
| ***F02F 7/00*** | (2006.01) |
| ***F02B 75/18*** | (2006.01) |

(56) References Cited

FOREIGN PATENT DOCUMENTS

| | | | |
|---|---|---|---|
| JP | 6-50188 | A | 2/1994 |
| JP | 6-288329 | A | 10/1994 |
| JP | 2510184 | Y2 | 9/1996 |
| JP | 2001-55944 | A | 2/2001 |
| JP | 2001-264350 | A | 9/2001 |
| JP | 2012-197712 | A | 10/2012 |
| JP | 2014-199040 | A | 10/2014 |

OTHER PUBLICATIONS

Written Opinion of the International Searching Authority, issued in PCT/JP2018/005954, dated May 15, 2018.
International Preliminary Report on Patentability, issued in PCT/JP2018/005954, dated Mar. 4, 2019.

* cited by examiner

INTERNAL COMBUSTION ENGINE

TECHNICAL FIELD

The present invention relates to an internal combustion engine that includes a crankcase that rotatably supports a crankshaft, a case cover that liquid-tightly covers a side of the crankcase, and a cylinder block that is joined to the crankcase and defines a plurality of cylinders in a V-type arrangement in which the cylinders are disposed above a virtual horizontal plane including a rotational axis of the crankshaft and intersect each other at a bank angle.

BACKGROUND ART

Patent Document 1 discloses a pulse sensor. The pulse sensor is made to face an outer rotor of a generator. The outer rotor is fixed to an extremity of a crankshaft. A piece of to-be-detected body is mounted on an outer face of the outer rotor. The pulse sensor detects the to-be-detected body in response to rotation of the outer rotor and generates a pulse signal while synchronizing it with the rotation in response to the to-be-detected body being detected.

Patent Document 2 discloses a ring gear (to-be-detected body) that is mounted on a crankshaft of an internal combustion engine when determining misfiring. An extremity of an eddy current type microdisplacement sensor (detection sensor) opposes an outer peripheral face of the ring gear. The microdisplacement sensor detects the crank angle. The positional relationship between a crank chamber of the internal combustion engine and the microdisplacement sensor is not disclosed.

RELATED ART DOCUMENTS

Patent Documents

Patent Document 1: Japanese Utility Model Registration Publication No. 2510184

Patent Document 2: Japanese Patent Application Laid-open No. 2014-199040

SUMMARY OF THE INVENTION

Problems to be Solved by the Invention

It is desired that when determining misfiring, the angular velocity of a crankshaft is detected with high precision. However, when the outer rotor of a generator plays the role of a ring gear, since the generator is disposed at a shaft end of the crankshaft, the run-out of the crankshaft increases, and it is difficult to detect the angular velocity of the crankshaft with high precision.

The present invention has been accomplished in light of the above circumstances, and it is an object thereof to provide, in a so-called V-type internal combustion engine, a structure for disposing a detection sensor that can detect the angular velocity of a crankshaft with high precision.

Means for Solving the Problems

According to a first aspect of the present invention, there is provided an internal combustion engine comprising a crankcase that rotatably supports a crankshaft, a case cover that liquid-tightly covers a side of the crankcase, a cylinder block that is joined to the crankcase and has a plurality of cylinders in a V-type arrangement in which the cylinders are disposed above a virtual horizontal plane including a rotational axis of the crankshaft and intersect each other at a bank angle, a to-be-detected body that rotates integrally with the crankshaft, and a detection sensor that is mounted from an outside on the crankcase at a position higher than the virtual horizontal plane and is made to face a trajectory of the to-be-detected body to generate a pulse signal in response to movement of the to-be-detected body.

According to a second aspect of the present invention, in addition to the first aspect, the detection sensor faces a cam chain chamber that is defined between an outer face of the crankcase and the case cover and houses a cam chain transmitting power from the crankshaft to a cam shaft.

According to a third aspect of the present invention, in addition to the second aspect, the internal combustion engine further comprises two pistons that are housed in the cylinders and are linked in common to one crank pin of the crankshaft by means of a connecting rod, and a cam chain chamber that is disposed on a side opposite to the cam chain chamber, in an axial direction of the crankshaft, that corresponds to one piston and is defined between an outer face of the crankcase and the case cover, the cam chain chamber corresponding to the other piston and housing a cam chain transmitting power from the crankshaft to the cam shaft.

According to a fourth aspect of the present invention, in addition to any one of the first to third aspects, the detection sensor is disposed at a position overlapping either one of the cylinders when viewed from a side of a vehicle body.

According to a fifth aspect of the present invention, in addition to any one of the first to fourth aspects, the detection sensor overlaps the cylinder block when viewed from the front of the vehicle body.

According to a sixth aspect of the present invention, in addition to any one of the first to fifth aspects, the detection sensor comprises a main body that is inserted into a through hole formed in the crankcase and faces an oil chamber via a detection part at an extremity thereof, a connector that is joined to the main body and is disposed in a space outside the crankcase, and a fastening piece that is joined to the main body and fastened to the outer face of the crankcase.

According to a seventh aspect of the present invention, in addition to any one of the first to sixth aspect, the internal combustion engine further comprises a drive gear that is disposed so as to be adjacent to the to-be-detected body and is supported on the crankshaft, a length in a radial direction of the to-be-detected body being larger than a diameter of the drive gear.

Effects of the Invention

In accordance with the first aspect, due to the detection sensor being mounted on the crankcase the to-be-detected body can be separated from an outer rotor of the generator. In this way the influence of an electromagnetic force acting between the outer rotor and an inner stator can be avoided. The angular velocity of the crankshaft can be detected with high precision. Moreover, even if the detection sensor faces the oil chamber, since the detection sensor is positioned higher than the virtual horizontal plane including the rotational axis of the crankshaft, it is difficult for scattered oil to splash on the detection sensor. In addition, since the detection sensor is mounted from the outside of the crankcase, any increase in the dimensions of the crankcase or the case cover can be avoided.

In accordance with the second aspect, for example, in the V-type two cylinder internal combustion engine, the cam chain is linked at opposite ends of the crankshaft in the axial direction of the crankshaft. The cam chain chamber of one cylinder is disposed so as to be displaced in the axial direction of the crankshaft from the cylinder of the other cylinder. Therefore, a space opening so as to be adjacent to the cylinder of the other cylinder is ensured on the outer face of the crankcase. Since the detection sensor is disposed in this open space, a new placement of the detection sensor can be realized while maintaining the structure of the internal combustion engine.

In accordance with the third aspect, in the V-type internal combustion engine in which two connecting rods are connected to one crank pin, due to the cam chain chamber of the front bank being provided on the side opposite to the cam chain chamber of the rear bank, a wide space for placement of the detection sensor is ensured. On the other hand, if cam chain chambers of two banks were disposed on one side in the axial direction of a crankshaft, a space for placement of a detection sensor would be required in addition to a space for the two cam chain chambers being ensured, and the dimension of the internal combustion engine in the axial direction of the crankshaft could increase.

In accordance with the fourth aspect, the detection sensor can be protected behind the cylinder.

In accordance with the fifth aspect, the detection sensor can be protected behind the cylinder.

In accordance with the sixth aspect, since the detection sensor is merely inserted into the through hole of the crankcase, the detection sensor can easily be fitted into the internal combustion engine.

In accordance with the seventh aspect, due to the diameter of the to-be-detected body being larger than that of the drive gear, the detection sensor does not interfere with the drive gear, and the detection sensor can easily be disposed.

EXPLANATION OF REFERENCE NUMERALS AND SYMBOLS

Figure 1:
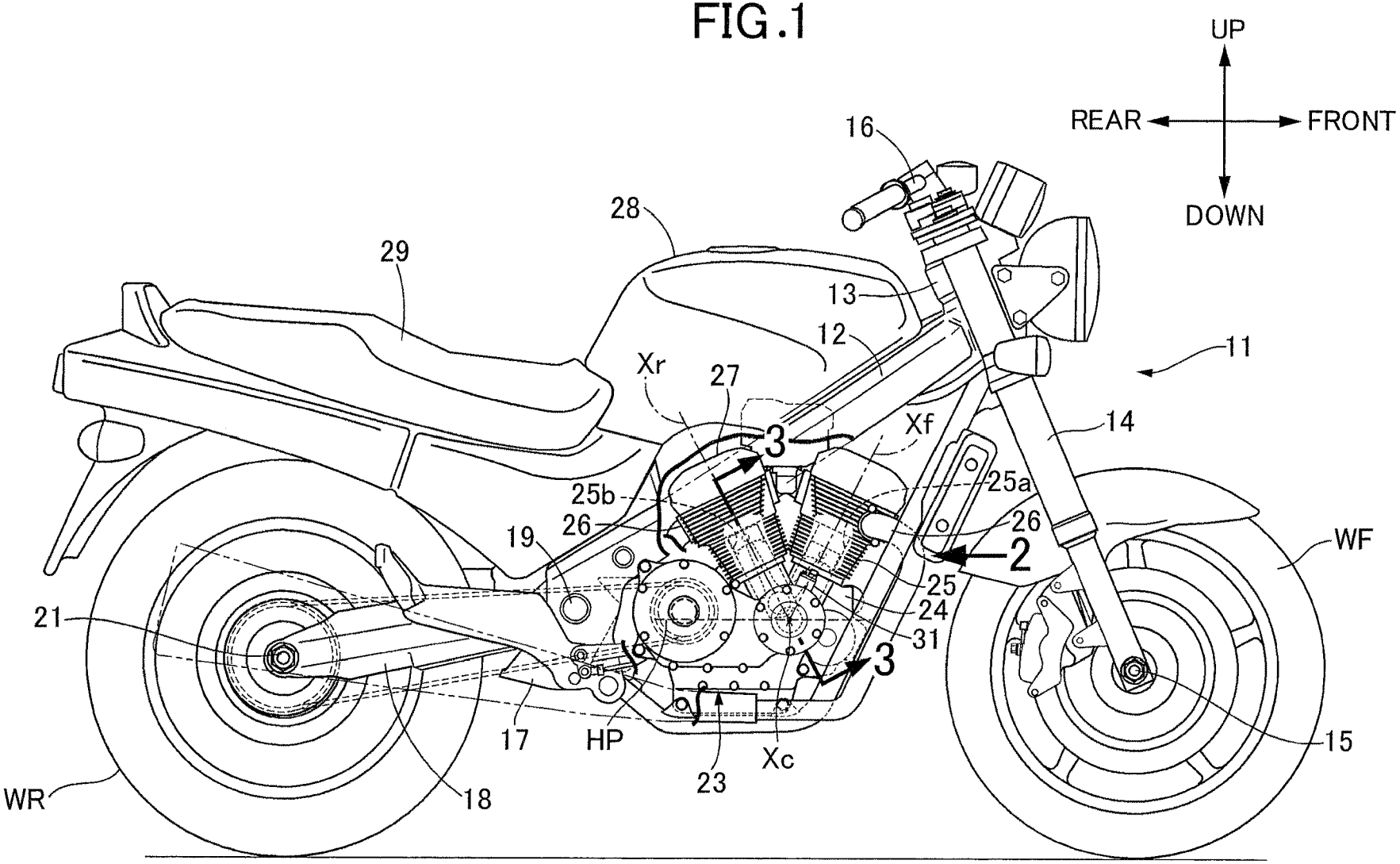
FIG. 1 is a side view schematically showing the overall arrangement of a two-wheeled motor vehicle. (first embodiment)

23 Internal combustion engine
24 Crankcase
25 Cylinder block
25*a* Cylinder (front side)
25*b* Cylinder (rear side)
31 Detection sensor (pulser sensor)
32 Piston
33 Crank chamber (part of oil chamber)
34 Crank
35 Crankshaft
37*a* Connecting rod
37*b* Connecting rod
53*a* Cam chain
53*b* Cam chain
54 Case cover
55*a* Cam chain chamber
55*b* Cam chain chamber
56 To-be-detected body (pulser ring)
57 Through hole
58 Main body
59 Connector
61 Fastening piece
HP Virtual horizontal plane
Xc Rotational axis (of crankshaft).

MODES FOR CARRYING OUT THE INVENTION

One embodiment of the present invention is explained below by reference to the attached drawings. Here, the top and bottom, front and rear, and left and right of a vehicle body are defined based on the point of view of a person riding a two-wheeled motor vehicle.

First Embodiment

FIG. 1 schematically shows the overall arrangement of a two-wheeled motor vehicle related to one embodiment of the present invention. A two-wheeled motor vehicle 11 includes a vehicle body frame 12. A front fork 14 is steerably supported on a head pipe 13 at the front end of the vehicle body frame 12. A front wheel WF is supported by the front fork 14 so that it can rotate around an axle 15. Handlebars 16 are joined to the front fork 14 on the upper side of the head pipe 13. A swing arm 18 is supported on a pivot frame 17 on the rear side of the vehicle body frame 12 so that it can swing around a support shaft 19 extending horizontally in the vehicle width direction. A rear wheel WR is supported at the rear end of the swing arm 18 so that it can rotate around an axle 21.

An internal combustion engine 23 is mounted on the vehicle body frame 12 between the front wheel WF and the rear wheel WR. The internal combustion engine 23 is arranged as a V-type two-cylinder internal combustion engine. That is, the internal combustion engine 23 includes a crankcase 24, a cylinder block 25 that is joined to the crankcase 24 and defines a plurality of cylinders 25*a* and 25*b* of a V-type arrangement disposed higher than a virtual horizontal plane HP including a rotational axis Xc of a crankshaft 35, which is described later, and intersecting each other at a bank angle, a cylinder head 26 that is joined to the cylinder block 25 for each of the cylinders 25*a* and 25*b*, and a head cover 27 that is joined to the cylinder head 26. The rotational axis Xc of the crankshaft 35 is disposed in parallel with the axle 21 of the rear wheel WR. The first cylinder 25*a* on the front side has a cylinder axis Xf that is inclined forward at an angle that is half the bank angle with respect to a virtual vertical plane including the rotational axis Xc. The second cylinder 25*b* on the rear side has a cylinder axis Xr that is inclined rearward at an angle that is half the bank angle with respect to the virtual vertical plane including the rotational axis Xc. Rotation of the crankshaft 35 is transmitted to the rear wheel WR via a power transmission device (not illustrated).

A fuel tank 28 is mounted on the vehicle body frame 12 above the internal combustion engine 23. A rider's seat 29 is mounted on the vehicle body frame 12 to the rear of the fuel tank 28. Fuel is supplied from the fuel tank 28 to a fuel injection device of the internal combustion engine 23. When driving the two-wheeled motor vehicle 11 a rider straddles the rider's seat 29.

Figure 2:
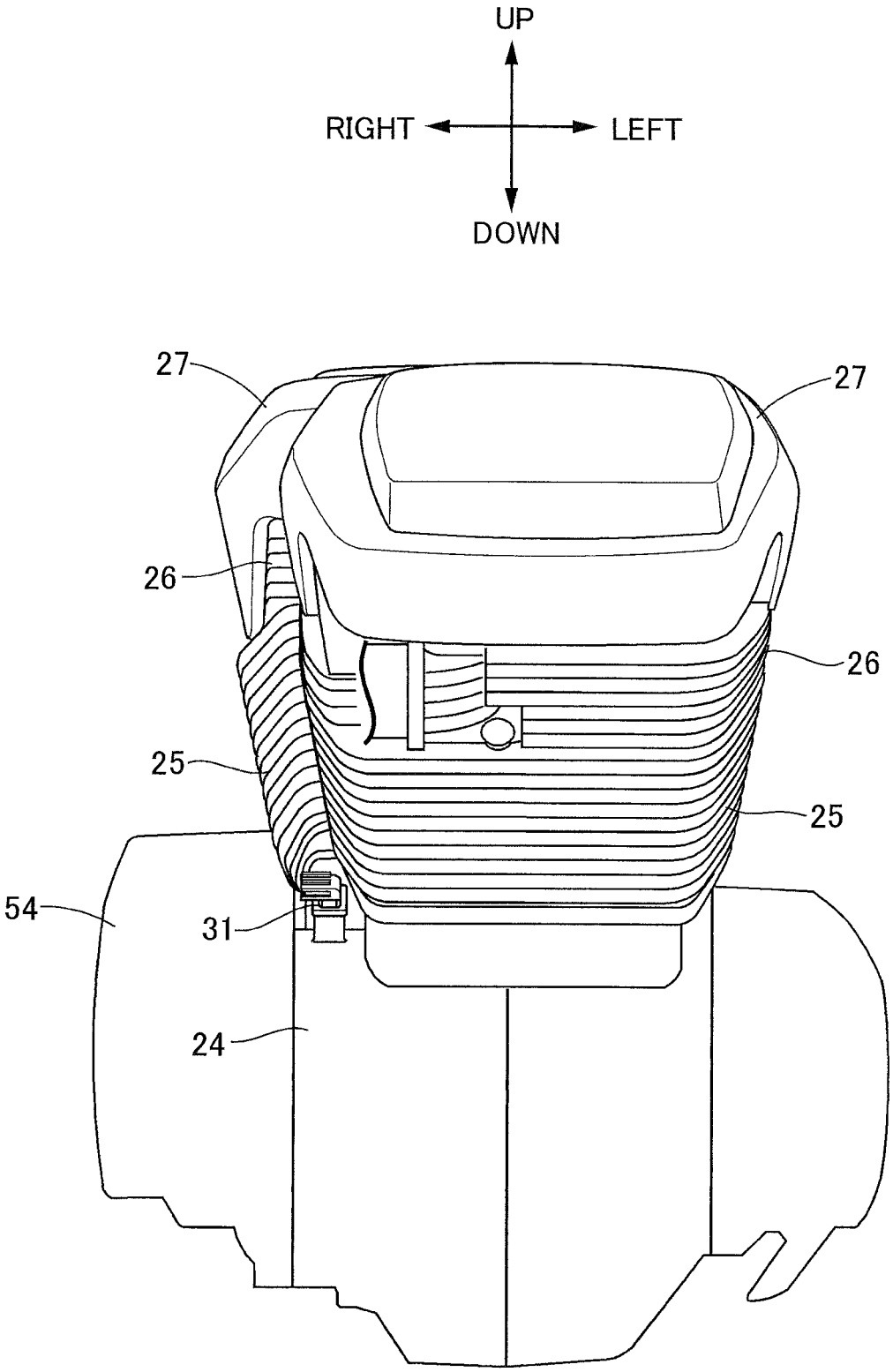
FIG. 2 is an enlarged front view of an internal combustion engine when viewed from the vehicle body front. (first embodiment)

The internal combustion engine 23 includes a pulser sensor (detection sensor) 31 that is mounted from the outside on the crankcase 24 at a position higher than the virtual horizontal plane HP. The pulser sensor 31 is disposed at a position overlapping the first cylinder 25*a* on the front bank when viewed from the side of the vehicle body. Here, a detection axis (described later) of the pulser sensor 31 is disposed within a virtual plane including the cylinder axis Xf of the first cylinder 25*a* and the rotational axis Xc. As shown in FIG. 2, the pulser sensor 31 overlaps the cylinder block 25 when viewed from the front of the vehicle body.

Figure 3:
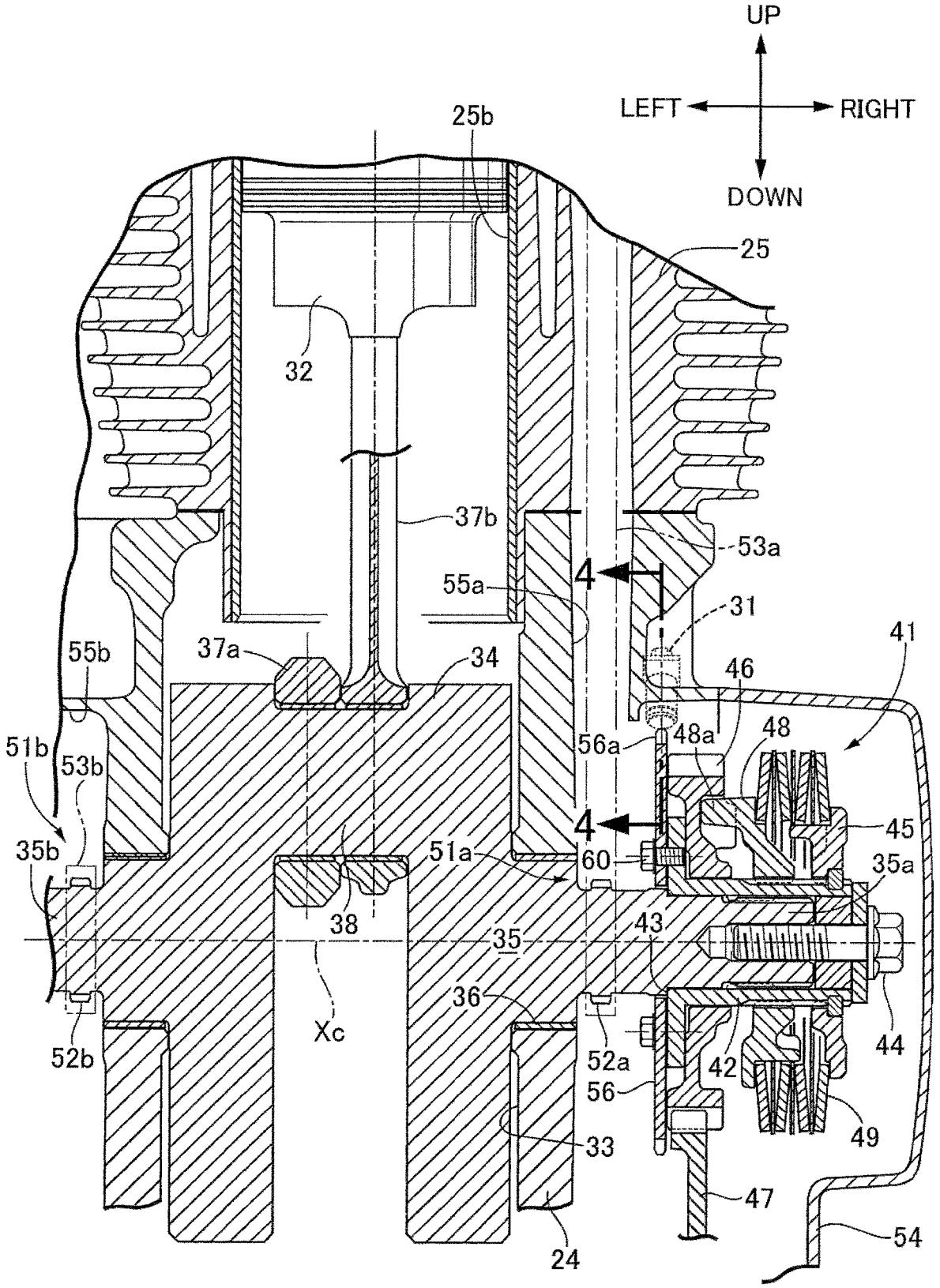
FIG. 3 is an enlarged partial sectional view of the two-wheeled motor vehicle schematically showing the structure of the internal combustion engine. (first embodiment)

As shown in FIG. 3, the internal combustion engine 23 includes a piston 32 incorporated into the cylinder block 25. Each of the cylinders 25*a* and 25*b* houses the piston 32. A combustion chamber (not illustrated) is defined between the piston 32 and the cylinder head 26.

The internal combustion engine 23 includes the crankshaft 35 having a crank 34 housed in a crank chamber 33. The crank chamber 33 is defined in the crankcase 24. The crankshaft 35 is supported via a bearing 36 on the crankcase 24 so that it can rotate around the rotational axis Xc.

The internal combustion engine 23 includes connecting rods 37*a* and 37*b*. A first end of each of the connecting rods 37*a* and 37*b* is linked to the piston 32. A second of each of the connecting rods 37*a* and 37*b* is linked to the crankshaft 35 within the crankcase 24. The connecting rod 37*a* of the first cylinder 25*a* and the connecting rod 37*b* of the second cylinder 25*b* are rotatably linked to one common crank pin 38. Linear movement of the piston 32 in the axial direction is converted into rotation of the crankshaft 35 by the action of the connecting rods 37*a* and 37*b*.

The crankshaft 35 has a first drive shaft 35*a* projecting to the outside of the crankcase 24 via one end side in the axial direction, and a second drive shaft 35*b* projecting to the outside of the crankcase 24 via the side opposite thereto (the other end side) in the axial direction. A back torque relief mechanism 41 is connected to the first drive shaft 35*a*. The back torque relief mechanism 41 includes a tubular body 42 that is relatively non-rotatably and axially non-displaceably fitted onto the first drive shaft 35*a*. The tubular body 42 is spline joined to the first drive shaft 35*a*, is abutted via its inner end against an outwardly facing step face 43 of the first drive shaft 35*a*, and is fixed in the axial direction by means of a bolt 44 that is coaxial with the first drive shaft 35*a*.

A flange piece 45 is fixed to the tubular body 42, the flange piece 45 being fixed so as to be non-displaceable in the axial direction. A drive gear 46 is made to face the flange piece 45, the drive gear 46 being fitted onto the first drive shaft 35*a* so that it cannot rotate relative to the first drive shaft 35*a*. The drive gear 46 meshes with an input gear 47 of a transmission (not illustrated).

An annular member 48 equipped with a dowel 48*a* is fitted between the flange piece 45 and the drive gear 46 so that it can be displaced in the axial direction. The annular member 48 is spline joined to the tubular body 42, and relative rotation between the annular member 48 and the tubular body 42 is prevented. An elastic member 49 is sandwiched between the flange piece 45 and the annular member 48. The elastic member 49 exerts a resilient force that drives the annular member 48 toward the drive gear 46. When the crankshaft 35 is rotating, the dowel 48*a* of the annular member 48 meshes with the drive gear 46, and the power of the crankshaft 35 is transmitted from the drive gear 46 to a transmission. When the drive gear 46 rotates excessively, the dowel 48*a* is pushed out from the drive gear 46, and the annular member 48 is displaced toward the flange piece 45 against the resilient force of the elastic member 49. The link between the annular member 48 and the drive gear 46 is released. Transmission of power from the drive gear 46 to the annular member 48 is prevented.

The internal combustion engine 23 includes a first valve operating mechanism 51*a* corresponding to the piston 32 housed in the cylinder 25*b* of the rear bank, and a second valve operating mechanism 51*b* corresponding to the piston 32 housed in the cylinder 25*a* of the front bank. The first valve operating mechanism 51*a* includes a sprocket 52*a* fixed to the first drive shaft 35*a* between the back torque relief mechanism 41 and the bearing 36. A cam chain 53*a* is wound around the sprocket 52*a*, the cam chain 53*a* corresponding to the cylinder 25*b* of the rear bank and transmitting power from the crankshaft 35 to a cam shaft (not illustrated).

A case cover 54 covering an outer face of the crankcase 24 so as to correspond to the first drive shaft 35*a* is joined to the crankcase 24. A first cam chain chamber 55*a* is defined between the outer face of the crankcase 24 and the case cover 54. The first cam chain chamber 55*a* extends from the side of the crankcase 24 up to the cylinder head 26 via the cylinder block 25. The first drive shaft 35*a*, the back torque relief mechanism 41, the sprocket 52*a*, and the cam chain 53*a* are housed in the first cam chain chamber 55*a*. The crank chamber 33 and the cam chain chamber 55*a* form an oil chamber that is filled with oil. Oil is used for lubrication of the piston 32, the bearing 36, the cam chain 53*a*, etc. The back torque relief mechanism 41 is covered by the case cover 54 and housed within the oil chamber (cam chain chamber 55*a*).

The second valve operating mechanism 51*b* includes a sprocket 52*b* that is fixed to the second drive shaft 35*b* outside the crankcase 24. A cam chain 53*b* is wound around the sprocket 52*b*, the cam chain 53*b* corresponding to the piston 32 housed in the cylinder 25*a* of the front bank and transmitting power from the crankshaft 35 to a cam shaft (not illustrated). An AC generator (not illustrated) is further joined to the second drive shaft 35*b*.

A generator cover (not illustrated) corresponding to the second drive shaft 35*b* and covering an outer face of the crankcase 24 is joined to the crankcase 24. A second cam chain chamber 55*b* is defined between the generator cover and the outer face of the crankcase 24, the second cam chain chamber 55*b* being disposed on the side opposite to the cam chain chamber 55*a* in the axial direction of the crankshaft 35. The second cam chain chamber 55*b* extends from the side of the crankcase 24 up to the cylinder head 26 via the cylinder block 25. The second drive shaft 35*b*, the AC generator, the sprocket 52*b*, and the cam chain 53*b* are housed in the second cam chain chamber 55*b*. The cam chain chamber 55*b* forms an oil chamber together with the crank chamber 33 and the cam chain chamber 55*a*.

The internal combustion engine 23 includes an annular plate-shaped pulser ring (to-be-detected body) 56 that is joined to the crankshaft 35 coaxially with the rotational axis Xc and rotates integrally with the crankshaft 35. The pulser ring 56 is fixed to the first drive shaft 35*a* between the drive gear 46 and the sprocket 52*a*. The pulser ring 56 is fastened to for example the tubular body 42 of the back torque relief mechanism 41 by means of a bolt 60. The pulser ring 56 is therefore adjacent to the drive gear 46. The length of the pulser ring 56 in the radial direction is longer than the diameter of the drive gear 46. The pulser ring 56 is housed within the oil chamber.

Figure 4:
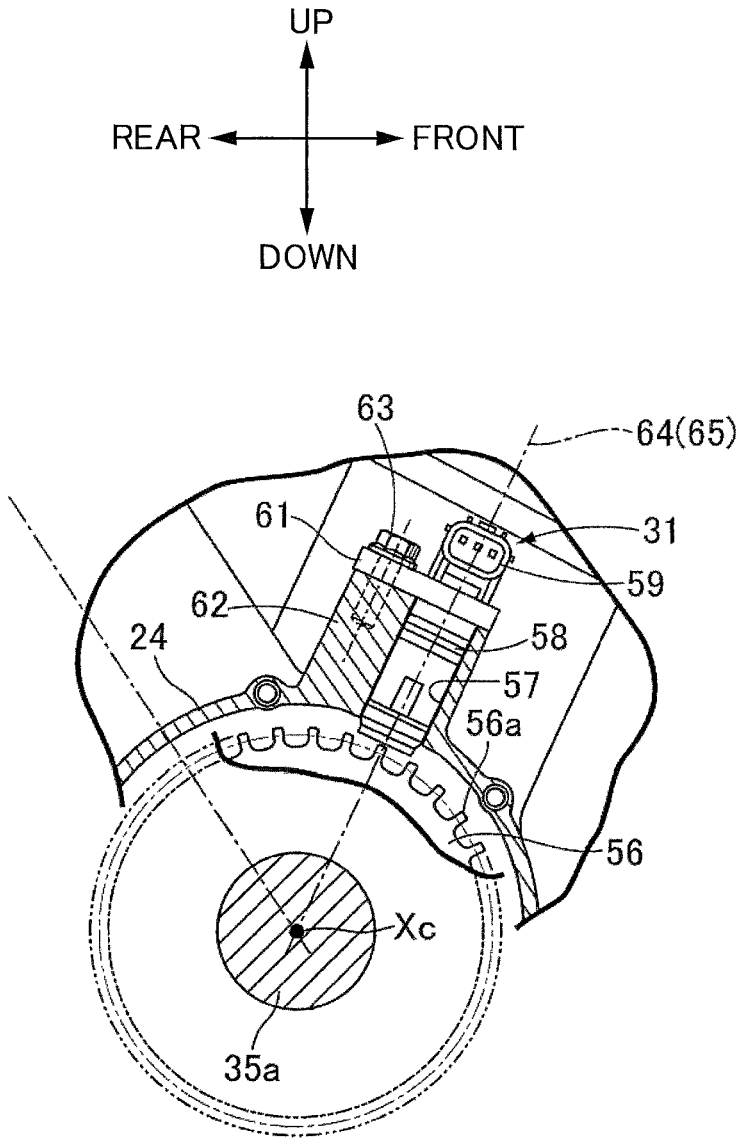
FIG. 4 is an enlarged sectional view along line 4-4 in FIG. 3. (first embodiment)

Referring in addition to FIG. 4, the pulser ring 56 includes a plurality of reluctors (gear teeth) 56*a* arranged at equal intervals in an annular shape around the rotational axis Xc. The reluctors 56*a* are disposed with a central angle of for example 10 degrees therebetween. The reluctor 56*a* is formed from for example a magnetic body. The pulser sensor 31 is made to face the annular trajectory of the pulser ring 56 and generates a pulse signal in response to movement of the pulser ring 56.

As shown in FIG. 4, the pulser sensor 31 includes a main body 58 that is inserted into a through hole 57 formed in the crankcase 24 and faces the oil chamber via a detection part at the extremity, a connector 59 that is joined to the main body 58 and disposed in a space outside the crankcase 24, and a fastening piece 61 that is joined to the main body 58 and fastened to the outer face of the crankcase 24. The pulser sensor 31 outputs an electric signal in response to the magnetic body, which is detected on the trajectory of the pulser ring 56, being present. The pulser sensor 31 outputs a pulse signal that identifies the angular position of the crankshaft 35. Alternatively, an eddy current type microdisplacement sensor may be used as the pulser sensor 31.

The fastening piece 61 is superimposed on an upper face of a pedestal 62 projecting from the outer face of the crankcase 24, and is fastened to the pedestal 62 by means of a bolt 63. In the pulser sensor 31 a detection axis 64 that has the highest sensitivity is directed at the rotational axis Xc of the crankshaft 35. The detection axis 64 is disposed within a virtual plane 65 including the rotational axis Xc and the cylinder axis Xf of the first cylinder 25*a*.

The operation of this embodiment is now explained. In the present embodiment the pulser sensor 31 is mounted from the outside on the crankcase 24 at a position higher than the virtual horizontal plane HP including the rotational axis Xc of the crankshaft 35. Due to the pulser sensor 31 being mounted on the crankcase 24 the pulser ring 56 can be separated from an outer rotor of the generator. In this way the influence of an electromagnetic force acting between the outer rotor and an inner stator is avoided. The angular velocity of the crankshaft 35 is detected with high precision. Moreover, even if the pulser sensor 31 faces the oil chamber (the crank chamber 33 or the cam chain chamber 55*a*), since the pulser sensor 31 is positioned higher than the virtual horizontal plane HP including the rotational axis Xs of the crankshaft 35, it is difficult for scattered oil to splash on the pulser sensor 31. In addition, since the pulser sensor 31 is mounted from the outside of the crankcase 24, any increase in the dimensions of the crankcase 24 or the case cover 54 is avoided. On the other hand, if the pulser sensor 31 were to be disposed on the inside of the crankcase 24 or the case cover 54, it would not be possible to avoid an increase in the dimensions of the crankcase 24 or the case cover 54. An increase in the dimensions of the crankcase 24 or the case cover 54 would cause a local increase in the weight of the internal combustion engine 23, thus degrading the weight balance of the internal combustion engine 23.

For example, in the V-type two cylinder internal combustion engine 23, the cam chain 53*a* is linked at opposite ends of the crankshaft 35 in the axial direction of the crankshaft 35. The cam chain chamber 55*a* of one cylinder is disposed so as to be displaced in the axial direction of the crankshaft 35 from the cylinder 25*a* of the other cylinder. Therefore, a space opening so as to be adjacent to the cylinder 25*a* of the other cylinder is ensured on the outer face of the crankcase 24. Since the pulser sensor 31 is disposed in this open space, a new placement of the pulser sensor 31 can be realized while maintaining the structure of the internal combustion engine 23.

In addition, in the V-type internal combustion engine 23, two connecting rods 37*a* and 37*b* are connected to one crank pin 38. The cam chain chamber 55*b* of the front bank is provided on the side opposite to the cam chain chamber 55*a* of the rear bank. Therefore, a wide space for placement of the pulser sensor 31 is ensured. On the other hand, if cam chain chambers of two banks were disposed on one side in the axial direction of a crankshaft, a space for placement of a pulser sensor would be required in addition to a space for the two cam chain chambers being ensured, and the dimension of the internal combustion engine 23 in the axial direction of the crankshaft 35 could increase.

The pulser sensor 31 is disposed at a position overlapping the first cylinder 25*a* when viewed from the side of the vehicle body. Therefore the pulser sensor 31 can be protected from stones, etc. scattered up behind the first cylinder 25*a*. As is clear from FIG. 2, the pulser sensor 31 overlaps the cylinder block 25 surrounding the second cylinder 25*b* when viewed from the front of the vehicle body. Therefore, the pulser sensor 31 can be protected from stones, etc. scattered up behind the second cylinder 25*b*.

The pulser sensor 31 is inserted into the through hole 57 formed in the crankcase 24 and faces the oil chamber via the detection part at the extremity. Since the pulser sensor 31 is merely inserted into the through hole 57 of the crankcase 24, the pulser sensor 31 can easily be fitted into the internal combustion engine 23.

In the present embodiment, the drive gear 46 connected to the input gear 47 of the transmission is disposed so as to be adjacent to the pulser ring 56. Due to the diameter of the pulser ring 56 being larger than that of the drive gear 46, the pulser sensor 31 does not interfere with the drive gear 46, and the pulser sensor 31 can easily be disposed.

The invention claimed is:

1. An internal combustion engine comprising:

a crankcase that rotatably supports a crankshaft;

a case cover that liquid-tightly covers a side of the crankcase;

a cylinder block that is joined to the crankcase and has a plurality of cylinders in a V-type arrangement in which the cylinders are disposed above a virtual horizontal plane including a rotational axis of the crankshaft and intersect each other at a bank angle;

a to-be-detected body that rotates integrally with the crankshaft; and a detection sensor that is mounted from an outside on the crankcase at a position higher than the virtual horizontal plane and is made to face a trajectory of the to-be-detected body to generate a pulse signal in response to movement of the to-be-detected body, wherein the detection sensor is disposed at a position overlapping either one of the cylinders when viewed from a side of a vehicle body, and wherein the detection sensor overlaps the cylinder block when viewed from a front of the vehicle body.

2. The internal combustion engine according to claim 1, wherein the detection sensor faces a cam chain chamber that is defined between an outer face of the crankcase and the case cover and houses a cam chain transmitting power from the crankshaft to a cam shaft.

3. The internal combustion engine according to claim 2, further comprising:

two pistons that are housed in the cylinders and are linked in common to one crank pin of the crankshaft by means of a connecting rod; and a cam chain chamber that is disposed on a side opposite to the cam chain chamber, in an axial direction of the crankshaft, that corresponds to one piston and is defined between an outer face of the crankcase and the case cover, the cam chain chamber corresponding to the other piston and housing a cam chain transmitting power from the crankshaft to the cam shaft.

4. The internal combustion engine according to claim 1, wherein the detection sensor comprises:

a main body that is inserted into a through hole formed in the crankcase and faces an oil chamber via a detection part at an extremity thereof;

a connector that is joined to the main body and is disposed in a space outside the crankcase; and a fastening piece that is joined to the main body and fastened to the outer face of the crankcase.

5. The internal combustion engine according to claim 1, further comprising a drive gear that is disposed so as to be adjacent to the to-be-detected body and is supported on the crankshaft, a length in a radial direction of the to-be-detected body being larger than a diameter of the drive gear.

* * * * *